US005961731A

United States Patent [19]

Cooper-Trotter

[11] Patent Number: 5,961,731

[45] Date of Patent: Oct. 5, 1999

[54] METHOD FOR REMOVING DELETERIOUS DEPOSITS FROM A SURFACE

[76] Inventor: Eunice Cooper-Trotter, 2626 Traver, Ann Arbor, Mich. 48105

[21] Appl. No.: 08/993,845

[22] Filed: Dec. 18, 1997

[51] Int. Cl.[6] ..... B08B 7/00; C11D 7/16

[52] U.S. Cl. ..... 134/6; 510/109; 510/118

[58] Field of Search ..... 134/6, 7, 42; 422/28; 510/109, 118

[56] References Cited

U.S. PATENT DOCUMENTS 3,702,769 11/1972 Vaughn .
3,955,986 5/1976 Miller .
4,208,213 6/1980 Müller et al. .
4,344,932 8/1982 Gordon .
5,227,085 7/1993 Motsenbocker .
5,403,402 4/1995 LeGrow .
5,639,310 6/1997 Giampaolo, Jr. ..... 134/6

*Primary Examiner*—Jill Warden
*Assistant Examiner*—Yolanda E. Person
*Attorney, Agent, or Firm*—Young & Basile, P.C.

[57] ABSTRACT

A method for removing a scuff mark from a shoe surface made from a synthetic material comprises the steps of: applying a fingernail polish remover composition to the shoe surface with a cotton ball; rubbing the composition into the surface; and removing the scuff mark and the composition from the surface. The composition may consist essentially of acetone; water; glycerin; diglycerol; and gelatin. The composition may alternately consist essentially of ethyl acetate; isopropyl alcohol; water; benzophenone 1; isopropyl myristate; butyl acetate; and mineral salts containing sodium, potassium, magnesium, calcium, chloride, bromide, iodide, sulfate, and carbonate. Still further, the composition may alternately consist essentially of other nail polish remover compositions.

17 Claims, No Drawings

METHOD FOR REMOVING DELETERIOUS DEPOSITS FROM A SURFACE

BACKGROUND OF THE INVENTION

The present invention relates generally to a method for removing deleterious deposits from a surface, and more particularly to such a method which will remove scuff marks from shoes.

The appearance of one's shoes may often create either a favorable or an unfavorable impression upon others. Especially in certain situations, such as interviews for potential employment, important social situations, church gatherings, and the like, a person wishes to "put his/her best foot forward," in a manner of speaking. As such, wearing clean and lustrous shoes is highly desirable.

Traditional shoe cleaning and/or polishing compositions may be suitable in some situations. However, there are times when one must clean a mark or marks off one's shoes more quickly than with a traditional cleaner or polish. Further, a person may need to clean a mark or marks off his/her shoe(s) without access to traditional cleaners or polishes. Also, although traditional cleaners and/or polishes may work well, they may be too expensive for some consumers to afford, especially when the consumer only cleans and/or spot cleans his shoes on infrequent occasions. Further, with traditional polishes, the entire upper surfaces of both shoes must be polished in order appear the same, and a person may not have the time and/or desire to do so.

Thus, it is an object of the present invention to provide a method for removing deleterious deposits from a shoe surface thus restoring it as closely as possible to a clean and lustrous condition, which method is advantageously very quick and simple to accomplish. It is a further object of the present invention to provide such a method which may be accomplished with a common household item, which item advantageously is relatively inexpensive to purchase. Still further, it is an object of the present invention to provide such a method which may be used for spot cleaning/shining one or more discrete area(s) on the shoe, without requiring cleaning or polishing of the entire upper surfaces of both shoes in a pair.

SUMMARY OF THE INVENTION

The present invention addresses and solves the above-mentioned problems and meets the enumerated objects and advantages, as well as others not enumerated, by providing a method for removing a scuff mark from a shoe surface made from a synthetic material. The method comprises the steps of: applying a fingernail polish remover composition to the shoe surface with a cotton ball; rubbing the composition into the surface; and removing the scuff mark and the composition from the surface.

The composition may consist essentially of acetone; water; glycerin; diglycerol; and gelatin. The composition may alternately consist essentially of ethyl acetate; isopropyl alcohol; water; benzophenone 1; isopropyl myristate; butyl acetate; and mineral salts containing sodium, potassium, magnesium, calcium, chloride, bromide, iodide, sulfate, and carbonate. Still further, the composition may alternately consist essentially of other nail polish remover compositions.

DETAILED DESCRIPTION OF THE PREFERRED EMBODIMENTS

The present invention comprises a method for removing a deleterious deposit from a surface, the surface being other than a human nail. It is to be understood that the surface may be a synthetic (man-made) surface, a hard surface, a leather surface, and the like. The present method removes deleterious deposits, stains, and/or scuff marks and the like so as to restore the surface as closely as possible to a clean and/or shiny/glossy condition. In the preferred embodiment, the surface is the "upper " portion (ie. non-sole portion) of a synthetic material shoe. Although a synthetic material shoe is the preferred surface, it is to be understood that the present method may work equally well on shoes made from other materials.

The method comprising the step of applying a fingernail polish remover composition to the surface with an applicator. It is to be understood that any suitable applicator may be used. However, in the preferred embodiment, a cotton ball is used. The method further comprises the steps of rubbing the composition into the surface; and removing the deleterious deposit and the composition from the surface.

It is to be understood that any suitable fingernail polish composition may be used, acetone-based, or non-acetone based. Although acetone-based compositions had been used for cleaning purposes in the past, it was believed that such compositions were too abrasive for surfaces such as shoes. However, the present invention is predicated upon the unexpected discovery that acetone or non-acetone based nail polish remover compositions may be used in a predetermined quantity for a predetermined amount of time upon shoe surfaces without damage to the shoe material.

In the preferred embodiment, the composition consists essentially of acetone; water; glycerin; diglycerol; and gelatin. The composition may optionally further consist essentially of fragrance; and yellow 11.

An alternate preferred composition consists essentially of ethyl acetate; isopropyl alcohol; SD alcohol 40-B; water; isostearoyl hydrolyzed collagen; castor oil; and benzophenone 1. The composition may optionally further consist essentially of fragrance; FD&C Red #4; and D&C Red #33.

A further alternate preferred composition consists essentially of ethyl acetate; isopropyl alcohol; water; benzophenone 1; isopropyl myristate; butyl acetate; and mineral salts containing sodium, potassium, magnesium, calcium, chloride, bromide, iodide, sulfate, and carbonate. The composition may optionally further consist essentially of fragrance; D&C Red #17; and D&C Violet #2.

Yet a further alternate preferred composition consists essentially of: between about 1% and about 75% by weight acetone; between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of decamethylcyclopentasiloxane, 3-hexyl-1,1,1,3,5,5,5-heptamethyltrisiloxane, and 3-phenyl-1,1,1,3,5,5,5-heptamethyltrisiloxane.

Still yet a further alternate preferred composition consists essentially of: between about 1% and about 75% by weight acetone; between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of a volatile short chain linear silicone fluid having only methyl groups and phenyl groups as substituents on silicon atoms, and a volatile short chain linear silicone fluid having only methyl groups and alkyl groups with six to twelve carbon atoms as substituents on silicon atoms.

A further alternate preferred composition consists essentially of:

a first chelating agent selected from the group consisting of ethylene diamine tetraacetic acid and alkali metal salts thereof, phytol, phytic acid, nitrilotriacetic acid, diethylene triamino pentaacetic acid, sodium tripolyphosphates, sodium metaphosphate, sodium hexamethaphosphate, trisodium phosphate, and ethylene diaminotetraacetic acid;

a second chelating agent selected from the group consisting of urea, urea precursors, allantoin, penthenol, and aloe vera extract; and a liquid carrier, such as water, present in an amount sufficient to solvate or disperse the first and the second chelating agents.

It is to be understood that the first chelating agent is generally more effective than the second chelating agent, and that the second chelating agent may also be a solubilizing agent.

Although several alternate embodiments of the nail polish remover composition have been set forth hereinabove, it is to be understood that many various compositions may successfully be used in the present inventive method. Generally, lighter or clear colored removers may work better on lighter colored shoes; whereas any color and/or type may be used on darker colored shoes.

To further illustrate the inventive method, the following examples are given. It is to be understood that these examples are provided for illustrative purposes and are not to be construed as limiting the scope of the present invention.

EXAMPLE 1

A light-colored shoe having an upper (non-sole) surface made from a synthetic (man-made) material had a scuff mark thereon. A nail polish remover composition was placed on a cotton ball. The nail polish remover composition consisted essentially of acetone; water; glycerin; diglycerol; gelatin; fragrance; and yellow 11. The remover was CUTEX brand "REGULAR" protein enriched polish remover, commercially available from Chesebrough-Pond's USA Co. in Greenwich, Conn. The cotton ball containing the polish remover was then rubbed onto the scuff mark on the shoe. The cotton ball was further wiped onto and around the scuff mark surface until the mark and the polish remover were removed from the surface. The shoe was returned to its clean and lustrous condition.

EXAMPLE 2

A light-colored shoe having an upper (non-sole) surface made from a synthetic (man-made) material had a scuff mark thereon. A nail polish remover composition was placed on a cotton ball. The nail polish remover composition consisted essentially of ethyl acetate; isopropyl alcohol; water; benzophenone 1; isopropyl myristate; butyl acetate; mineral salts containing sodium, potassium, magnesium, calcium, chloride, bromide, iodide, sulfate, and carbonate; fragrance; D&C Red #17; and D&C Violet #2. The remover was REVLON brand "PROFESSIONAL NAIL ENAMEL REMOVER", EXTRA GENTLE, commercially available from Revlon Consumer Products Corporation in New York, N.Y. The cotton ball containing the polish remover was then rubbed onto the scuff mark on the shoe. The cotton ball was further wiped onto and around the scuff mark surface until the mark and the polish remover were removed from the surface. The shoe was returned to its clean and lustrous condition.

While preferred embodiments of the invention have been described in detail, it will be apparent to those skilled in the art that the disclosed embodiments may be modified. Therefore, the foregoing description is to be considered exemplary rather than limiting, and the true scope of the invention is that defined in the following claims.

What is claimed is:

1. A method for removing a deleterious deposit from a surface, the surface being other than a human nail, the method comprising the steps of:

applying a fingernail polish remover composition to the surface with an applicator;

rubbing the composition into the surface, wherein the deleterious deposit is a scuff mark; and removing the deleterious deposit and the composition from the surface.

2. The method as defined in claim 1 wherein the surface is a shoe.

3. The method as defined in claim 2 wherein the shoe is made from a synthetic material.

4. The method as defined in claim 1 wherein the applicator is a cotton ball.

5. The method as defined in claim 1 wherein the composition consists essentially of acetone; water; glycerin; diglycerol; and gelatin.

6. The method as defined in claim 1 wherein the composition consists essentially of ethyl acetate; isopropyl alcohol; SD alcohol 40-B; water; isostearoyl hydrolyzed collagen; castor oil; and benzophenone 1.

7. The method as defined in claim 1 wherein the composition consists essentially of ethyl acetate; isopropyl alcohol; water; benzophenone 1; isopropyl myristate; butyl acetate; and mineral salts containing sodium, potassium, magnesium, calcium, chloride, bromide, iodide, sulfate, and carbonate.

8. The method as defined in claim 1 wherein the composition consists essentially of:

between about 1% and about 75% by weight acetone;

between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of decamethylcyclopentasiloxane, 3-hexyl-1,1,1,3,5,5,5-heptamethyltrisiloxane, and 3-phenyl-1,1,1,3,5,5,5-heptamethyltrisiloxane.

9. The method as defined in claim 1 wherein the composition consists essentially of:

between about 1% and about 75% by weight acetone;

between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of a volatile short chain linear silicone fluid having only methyl groups and phenyl groups as substituents on silicon atoms, and a volatile short chain linear silicone fluid having only methyl groups and alkyl groups with six to twelve carbon atoms as substituents on silicon atoms.

10. The method as defined in claim 1 wherein the composition consists essentially of:

a first chelating agent selected from the group consisting of ethylene diamine tetraacetic acid and alkali metal salts thereof, phytol, phytic acid, nitrilotriacetic acid, diethylene triamino pentaacetic acid, sodium tripolyphosphates, sodium metaphosphate, sodium hexamethaphosphate, trisodium phosphate, and ethylene diaminotetraacetic acid;

a second chelating agent selected from the group consisting of urea, urea precursors, allantoin, penthenol, and aloe vera extract; and a liquid carrier present in an amount sufficient to solvate or disperse the first and the second chelating agents;

wherein the first chelating agent is more effective than the second chelating agent, and the second chelating agent is also a solubilizing agent.

11. A method for removing a scuff mark from a shoe surface made from a synthetic material, the method comprising the steps of:

applying a fingernail polish remover composition to the shoe surface with a cotton ball;

rubbing the composition into the surface; and removing the scuff mark and the composition from the surface.

12. The method as defined in claim 11 wherein the composition consists essentially of acetone; water; glycerin; diglycerol; and gelatin.

13. The method as defined in claim 11 wherein the composition consists essentially of ethyl acetate; isopropyl alcohol; SD alcohol 40-B; water; isostearoyl hydrolyzed collagen; castor oil; and benzophenone 1.

14. The method as defined in claim 11 wherein the composition consists essentially of ethyl acetate; isopropyl alcohol; water; benzophenone 1; isopropyl myristate; butyl acetate; and mineral salts containing sodium, potassium, magnesium, calcium, chloride, bromide, iodide, sulfate, and carbonate.

15. The method as defined in claim 11 wherein the composition consists essentially of:

between about 1 and about 75% by weight acetone;

between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of decamethylcyclopentasiloxane, 3-hexyl-1,1,1,3,5,5,5-heptamethyltrisiloxane, and 3-phenyl-1,1,1,3,5,5,5-heptamethyltrisiloxane.

16. The method as defined in claim 11 wherein the composition consists essentially of:

between about 1% and about 75% by weight acetone;

between about 1% and about 10% by weight water; and between about 1% and about 20% by weight of a volatile silicone fluid, the volatile silicone fluid having a vapor pressure of less than about 0.10 mm Hg, the volatile silicone fluid being selected from the group consisting of a volatile short chain linear silicone fluid having only methyl groups and phenyl groups as substituents on silicon atoms, and a volatile short chain linear silicone fluid having only methyl groups and alkyl is groups with six to twelve carbon atoms as substituents on silicon atoms.

17. The method as defined in claim 11 wherein the composition consists essentially of:

a first chelating agent selected from the group consisting of ethylene diamine tetraacetic acid and alkali metal salts thereof, phytol, phytic acid, nitrilotriacetic acid, diethylene triamino pentaacetic acid, sodium tripolyphosphates, sodium metaphosphate, sodium hexamethaphosphate, trisodium phosphate, and ethylene diaminotetraacetic acid;

a second chelating agent selected from the group consisting of urea, urea precursors, allantoin, penthenol, and aloe vera extract; and a liquid carrier present in an amount sufficient to solvate or disperse the first and the second chelating agents;

wherein the first chelating agent is more effective than the second chelating agent, and the second chelating agent is also a solubilizing agent.

* * * * *